United States Patent [19]

Bonitz

[11] 3,977,459

[45] Aug. 31, 1976

[54] CASTING A SHAPED ALUMINUM PART ON A WORK PIECE

[75] Inventor: Franz Bonitz, Vienna, Austria

[73] Assignee: Gruber & Kaja, Traun, Austria

[22] Filed: Dec. 4, 1974

[21] Appl. No.: 529,478

Related U.S. Application Data

[63] Continuation-in-part of Ser. No. 395,074, Sept. 7, 1973, abandoned.

[30] Foreign Application Priority Data

Nov. 4, 1974 Austria ..... 8834/74

[52] U.S. Cl. ..... 164/98

[51] Int. Cl.[2] ..... B22D 19/00

[58] Field of Search ..... 164/69, 70, 91, 92, 164/98, 99, 100, 101, 102, 103, 104, 105, 106, 109, 332, 334

[56] References Cited

UNITED STATES PATENTS

| | | | |
|---|---|---|---|
| 2,970,065 | 1/1961 | Greene et al. | 164/103 X |
| 3,007,219 | 11/1961 | Jepson | 164/106 X |
| 3,064,112 | 11/1962 | Hanzel | 164/98 X |
| 3,465,423 | 9/1969 | Kiesler et al. | 164/102 X |

FOREIGN PATENTS OR APPLICATIONS

| | | | |
|---|---|---|---|
| 241,282 | 5/1960 | Australia | 164/112 |
| 555,905 | 9/1943 | United Kingdom | 164/99 |
| 763,841 | 12/1956 | United Kingdom | 164/105 |
| 965,438 | 7/1964 | United Kingdom | 164/112 |

*Primary Examiner*—Ronald J. Shore
*Attorney, Agent, or Firm*—Kurt Kelman

[57] ABSTRACT

An aluminum or aluminum alloy melt is cast and shaped directly on the surface of a work piece and permitted to contact the surface without exerting pressure on the melt for at least a portion of the time that a temperature of 500°C to 700°C is maintained at the interface between the melt and the surface until an intermediate layer of an alloy of aluminum and chromium or nickel contained in the work piece has been produced at the interface, and the melt is then permitted to solidify as a shaped part on the work piece.

13 Claims, 5 Drawing Figures

CASTING A SHAPED ALUMINUM PART ON A WORK PIECE

This is a continuation-in-part of my copending application Ser. No. 395,074, filed Sept. 7, 1973, now abandoned.

The present invention relates to a process for casting a shaped part of aluminum or an aluminum alloy onto the surface of a work piece containing chromium or nickel.

The use of compound metals has been known for a long time in many technical fields. Such compound metals, of which here only the metal combination produced by casting one metal on another is of interest, unite favorable characteristics of two metals for a certain application. Especially, the combination of cast-iron or steel parts with aluminum combined with such parts by casting the aluminum on the ferrous part is widely used. The problem consists in the achievement of an intimate metallic bond between the two metals. As the heat expansion coefficients of steel and aluminum are widely different, frequently occurring temperature changes in such compound metal bonds tend to loosen the bond and, with this, a deterioration of the heat transmission and the solidity ensues.

An improvement in the manufacture of iron-aluminum compound work pieces has been achieved by the so called Al-Fin-procedure. In this case, an intimate bond between aluminum and iron is achieved through the formation of a thin $FeAl_3$-bonding layer at the contact area or interface of both metal parts. For the formation of this layer, the prepared steel or cast iron part is dipped into an aluminum smelt and within a few minutes, an $FeAl_3$ layer is formed on the surface of the immersed part.

It has also been proposed to produce a cast-on aluminum bottom on stainless steel cooking pots by spraying a smelt of pure aluminum or an aluminum alloy on the stainless steel bottom and thus to form a compound metal bonding layer. The pot provided with the bonding layer is then placed into a form or mold and molten aluminum or aluminum alloy is cast into the form to shape the aluminum bottom under pressure and permit it to solidify under the molding pressure.

Cast-iron rotary sleeves or brake drums have been provided with light metal fins by using the Al-Fin procedure, which has also been used to strengthen the bottom of stainless steel pots and pans with an aluminum plating. As in the production of a sprayed-on bonding layer, this method, too, requires great care in avoiding the tendency of the aluminum cast-on to become loose under the frequent temperature changes to which kitchen utensils are subjected.

Immersion in, or spraying with, molten aluminum is avoided according to another known method wherein the aluminum or aluminum alloy melt is applied directly to the surface of a work piece kept in a mold at about room temperature and permitted to solidify to provide an aluminum bottom on a stainless steel pot or pan. Because of the alloy components of stainless steel, this produces a bond between the stainless steel and aluminum parts. This bond, however, is neither very strong nor uniform about the entire area, some zones being even free of any bond, because the solidification of the aluminum layer proceeds immediately upon application of the melt. Also, the quality of the bond tends to vary from cast to cast and it is impossible to assure reproducible results in mass manufacture. It has, therefore, been proposed to improve this method and to obtain a better bond by permitting the cast-on melt to solidify under pressure but no essential improvements have been obtained in this manner. It has, therefore, been suggested to seek better adherance of the aluminum cast-on to the stainless steel substrate by providing the substrate with protrusions extending into the cast-on and anchoring it to the substrate.

This invention seeks to avoid the disadvantages of the known procedure by casting and shaping an aluminum or aluminum alloy melt directly on the surface of the work piece in a mold or form to produce an interface between the melt and the surface, and permitting the melt to contact the surface without exerting pressure on the melt in the direction of the surface. The temperature is maintained at the interface in the range of about 500°C to about 700°C, preferably about 550°C to about 600°C, until an intermediate bonding layer of an alloy of aluminum and/or chromium or nickel has been produced at the interface. The melt is then permitted to solidify to form a shaped aluminum part on the surface of the work piece.

In this process, the melt is not suddenly cooled as it comes into contact with the substrate but remains at a temperature at which aluminum diffuses into the substrate and chromium and/or nickel from the substrate diffuses into the aluminum melt, thus assuring a very firm and uniform bonding layer at the interface.

According to a preferred embodiment of the invention, further improvement in the bonding is obtained by exerting pressure on the melt in the direction of the surface after the melt has first been permitted to contact the surface without pressure while maintaining the temperature in the indicated range and before permitting the melt to solidify. This pressure may range between 170 and 190 kg/sq.cm., with a minimum pressure of 150 kg/sq.cm. However, it is also possible to permit the melt to solidify without exerting pressure in the direction of the surface, the above-indicated temperature range being maintained for a period of about 2 to 12 seconds, preferably 4 to 6 seconds, for instance.

The above and other objects, advantages and features of the present invention will become more apparent from the following detailed description of certain preferred embodiments thereof, taken in conjunction with the accompanying drawing wherein FIG. 1 shows a vertical cross section of a cooking pot blank with a cast-on reinforcing bottom;

Figure 1:
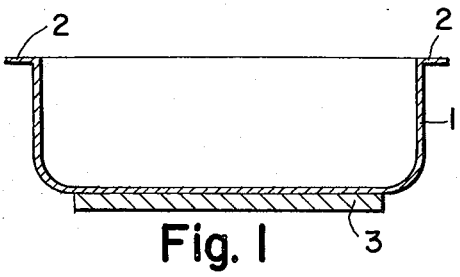

Referring now to the drawing, and first to FIG. 1, pot blank 1, with flange 2, consists of stainless steel containing chromium or chromium and nickel, and has aluminum plate 3 cast on its bottom.

Figure 2:
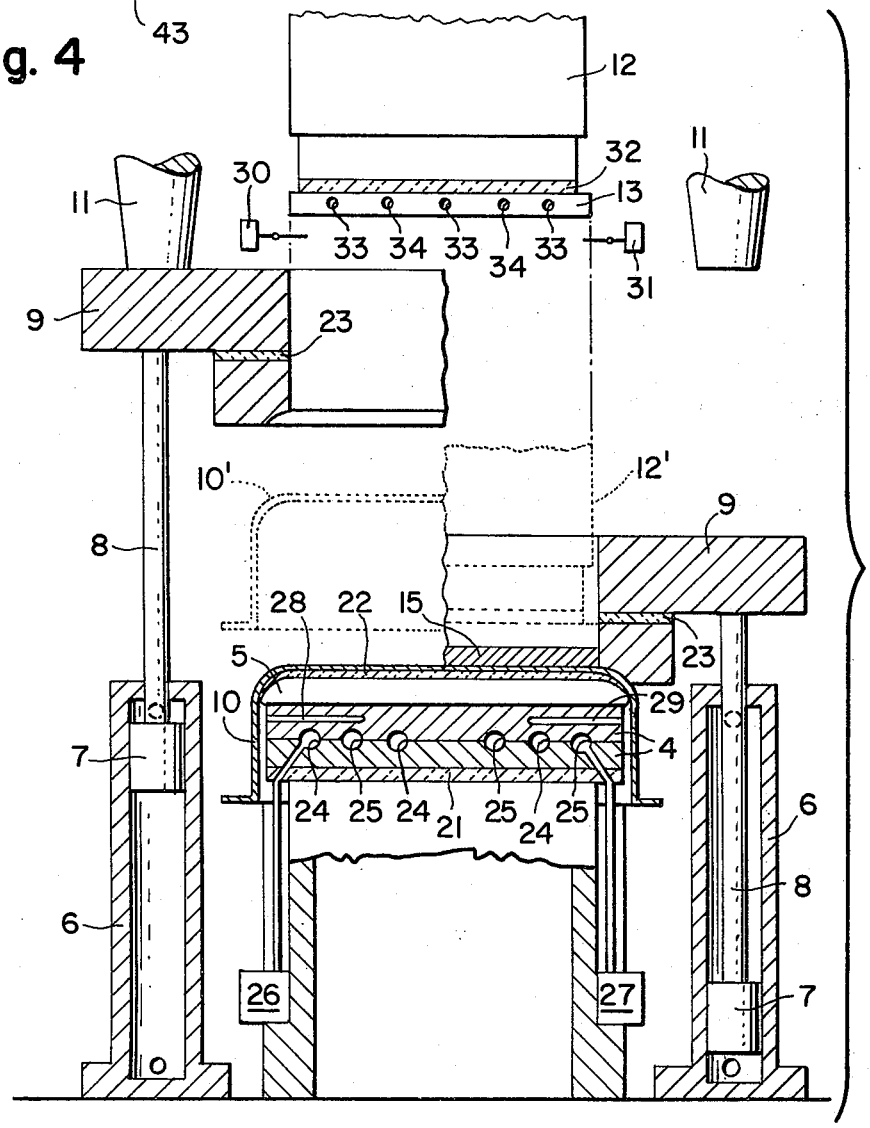
FIG. 2 is a schematic side elevational view, partly in section, of an apparatus useful in the process of this invention, the left and right sides of the figures showing the apparatus in different operating stages.

The power press illustrated in FIG. 2 comprises die block 4 with centering flange 5 cooperating with clamping ring 9 which is vertically reciprocable by a pressure fluid motor consisting of cylinders 6 wherein pistons 7 are slidably mounted, piston rods 8 being coupled to the clamping ring. In the left side of FIG. 2, clamping ring 9 has been shown at its upper end position determined by stops 11 while the right side of the figure shows the clamping ring in its lowered position in pressure contact with the bottom of pot blank 10.

The clamping ring defines an open molding chamber adapted to receive press die 12 whose leading flange 13 is dimensioned to engage the side wall of the molding chamber so as to delimit a space for shaping melt 15 cast on the bottom of blank 10 in the form defined by the molding chamber of the clamping ring. Obviously, it would be possible to reverse the mobility of the die block and press die, i.e. to arrange the press die fixedly while the die block is vertically reciprocable in relation thereto.

The operation of the press will be obvious from the described structure and proceeds as follows:

When clamping ring 9 is raised, enough space is provided to enable pot blank 10 to be placed on flange 5 of die block 4. Preferably, the surface of the blank on which the aluminum melt is to be cast is treated with a flux, either before the blank is placed on the die block or thereafter. It may also be useful to coat the mold or die parts which come into contact with the melt with a suitable material preventing adherence of the melt to the die parts. Fluxes and separating materials are well known in the casting art.

After the blank is in place, pressure fluid motor 6, 7, 8 is actuated to lower the clamping ring from the position shown at the left-hand side of FIG. 2 to that illustrated at the ring-hand side. As shown in the drawing, clamping ring 9 has an annular recess conforming to the peripheral portion of the bottom of blank 10 for full engagement therewith. After the clamping ring has thus been positioned, an accurately metered amount of a melt of aluminum or an aluminum alloy of high aluminum content is poured without pressure into the cylindrical molding chamber defined by an axial bore in the clamping ring to form layer 15 on the bottom of blank 10.

In the exemplified embodiment, the blank is made of a stainless steel sheet and the melt has a temperature of about 600°C to 750°C, preferably 640°C to 680°C, as it is cast on the surface of the blank. To prevent the melt from suddenly cooling on contact with the blank, the temperature of the blank or the portion thereof in contact with the melt is maintained at about 500°C to 700°C, preferably 550°C to 600°C. This is facilitated in accordance with a preferred embodiment of this invention by thermally insulating the die block in respect of its carrier. In the illustrated embodiment, this insulation comprises insulating layer 21, for instance of asbestos or the like, placed between die block 4 and its carrier. In addition, a like or similar thermally insulating layer 22 is shown being placed over centering flange 5 of the die block for regulation of the temperature. Furthermore, insulating layer 23 may also be provided in clamping ring 9. With such insulation, practically no heat will be transmitted from the casting region so that the temperature may be maintained at the indicated range until an intermediate layer of an alloy of aluminum and chromium and/or nickel has been produced at the interface between melt 15 and blank 10. Preferably, the melt is permitted to interact with the blank surface without pressure being exerted in the direction of the surface for 2 to 12, preferably 4 to 6, seconds.

If the thermal insulation of the casting region is not sufficient to maintain the indicated temperature for the desired period of time, die block 4 may be additionally heated. In the illustrated embodiment, the die block consists of two mating parts which define channels 24 adapted to receive an electrical resistance coil (not shown) connected to electric current source 26. Such additional heating will be desirable particulary with blanks of relatively large volume.

In the continuous production of pots of relatively small volume, the die block and the blank may reach a temperature in excess of the above-indicated range required for the effective operation of the process according to the present invention. Therefore, a cooling system is provided which comprises source 27 of a cooling medium connected to a cooling coil (not shown) mounted in channels 25 of die block 4. Heating and cooling are preferably thermostatically controlled, thermostats 28 and 29 in the die block actuating heating means 26 when the temperature falls below the indicated range and cooling means 27 when the temperature exceeds this range.

The melt cast into the molding chamber of clamping ring 9 to be shaped therein into layer 15 reacts with the surface of the blank without pressure before it solidifies and the temperature maintained at the interface causes melting of the surface so that chromium and/or nickel from the stainless steel of the blank diffuses into the aluminum melt while aluminum diffuses into the surface of the blank. It will be useful to adjust the stroke of the press die so that it will reach its closing position about 4 to 6 seconds after the melt has reacted without pressure with the metal on the surface of the blank. This produces a substantially continuous production cycle without interruptions.

As press die 12 is lowered, it will trip limit switches 30 and 31 which de-activate the heating and/or cooling means for the die block. The press die is lowered into end position 12' in which it exerts pressure on the melt in the direction of the surface of blank 10. The press die being of a heat conducting material, contact of the press die with the melt will remove heat therefrom and cause the same to solidify.

In the illustrated embodiment, thermally insulating layer 32 is arranged between leading flange 13 and the rest of the press die to delay the solidification of the melt and maintain the temperature in the elevated range indicated hereinabove for a given period of time, the period of pressure at this temperature range being at least a quarter of the period of the pressure exerted on the melt during solidification. In addition or instead of the thermal insulation, the press die may be heated and/or cooled similarly to the die block. Cooling and heating coils 33 and 34 are schematically indicated in leading flange 13 of the press die. This is particularly useful when the closing time of the press die has been selected according to the desired length of time for the melt to interact with the blank metal without pressure. When the melt is solidified under pressure, the corresponding densification of the cast metal will further increase the bond between the cast part and the blank. This densification will increase in direct proportion to the length of time used for solidification, this time being regulated effectively by insulating layer 32 and/or heating 33. The pressure exerted by the press die is adjusted to at least 150 kg/sq.cm. in the exemplified embodiment, with a preferred range of 170 to 190 kg/sq.cm. With an aluminum volume of 0.2 to 1.00 kg, the period of pressure is usefully about 15 to 30, preferably 18 to 20, seconds. These values relate primarily to shaped cast-on parts with a planar surface. If the surface of the cast-on part is not plane, pressures up to more than 1 ton/sq.cm. are possible.

After the layer 15 has solidified under pressure of lowered press die 12, the press die and clamping ring are raised and the work piece with the cast-on part is removed from the die block. As press die 12 passes by limit switches 30 and 31, the thermostatically controlled heating and/or cooling means are actuated again to make the apparatus ready for the next casting.

It is also possible to permit solidification of layer 15 without pressure, i.e. to operate the apparatus of FIG. 2 without press die 12. In this embodiment, too, it will be useful to heat and/or cool the die block and, for this purpose, actuating switches 30 and 31 may be operated manually. In this case, heat will be removed from the melt by convection and heat conduction through die block 4 until the layer has been solidified, the thermal isulation and/or the heating and cooling maintaining the temperature within the range of 500°C and 700°C for a minimum period of two seconds.

Furthermore, good results are also obtained when the melt first reacts with the metal of the work piece at the indicated temperature range without pressure, is then placed under vertical pressure for a short period of time, and finally permitted to solidify without pressure, the period of pressure being held to about 3 to 8 seconds, for instance, preferably 4 to 5 seconds, at a minimum of 150 kg/sq.cm., preferably 170 to 190 kg/sq.cm., for a volume of melt of 0.2 to 1 kg.

Useful metals for the work piece include stainless steels according to DIN (German Industry Standard) 17440, as listed on page 10 of DIN 17440. Particularly useful are steel types X7 Cr 13, No. 1.4000; X45 Cr Mo V15, No. 1.4116, and X8 Cr 17, No. 1.4016, according to DIN 17440. Useful melts may consist of purest, pure or metallurgical aluminum metal according to DIN 1712, Sheet 1 or 3, standard, or an aluminum alloy according to DIN 1715, Sheet 1 or 2, standard. A very useful aluminum alloy for the practice of the process consists of aluminum and, by weight, 12% Si and up to 0.01% Cu, 0.02% Mg, 0.01% Zn and 0.01% Ti. Other preferred aluminum alloys include 12.0 to 13.0% Si, 0.2 to 0.4% Mn and up to 0.1% Cu or up to 0.3% Fe, 0.15% Ti, 0.1% Zn, 0.05% Mg and 0.03% Cu, and up to 0.15% of traces of other components, none of the other components exceeding 0.05percent.

Teats have shown that the interface produced between the cast-on shaped aluminum part and the metal surface of the work piece, which produces the strong bond between the cast-on part and the work piece, consists of zone of diffusion of chromium and/or nickel in contact with the aluminum casting and a zone of diffusion of aluminum in contact with the surface of the work piece. If the work piece consists of stainless steel type X5CrNi189 according to DIN 17440, and an aluminum casting of the first named aluminum alloy containing 12% Si, the Al-diffusion zone has a width of 25 microns, the Cr-diffusion zone has a width of 50 microns and the Ni-diffusion zone has a width of 10 microns.

Figure 3:
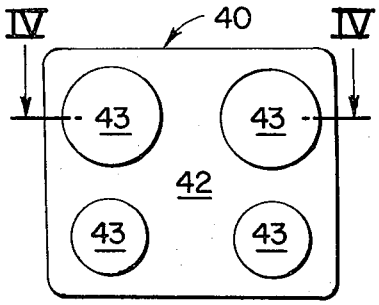
FIG. 3 is a top plan view of a stove plate with four cast-on heating plates.
Figure 4:
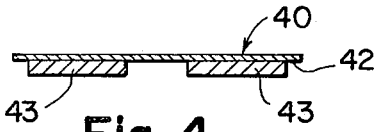
FIG. 4 is a vertical section along line IV—IV of FIG. 3.

The process of the invention is not limited to casting reinforcing bottoms on pots or pans, as illustrating in FIGS. 1 and 2. Other shaped parts may be cast on work pieces in an equivalent manner, as will be obvious to those skilled in the art. FIGS. 3 and 4, for instance, illustrate a stove plate 40 with heating plates 43 cast on underside 42 of the stove plate.

Figure 5:
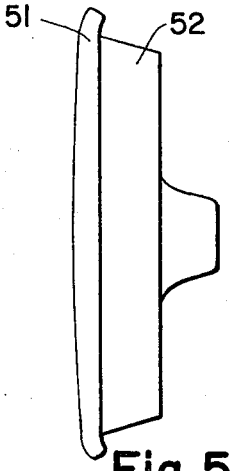
FIG. 5 is a side elevational view of gliding contact with a cast-on gliding face for tapping current from a current conducting rail.

FIG. 5 shows stainless steel gliding contact 51 having aluminum part 52 cast on its surface. Such a gliding contact or shoe may be used, for instance, in a high-speed vehicle for tapping electrical current from a current conducting rail. The stainless steel body of the contact provides the required high corrosion, abrasion and temperature resistance while the aluminum part assures good electrical conductivity.

I claim:

1. A process for casting a shaped part of aluminum or an aluminum alloy onto a surface of a work piece of a metal containing chromium or nickel, comprising the steps of 1. casting and shaping an aluminum or aluminum alloy melt directly on the surface of the work piece to produce an interface between the melt and the surface, and permitting the melt to contact the surface without exerting pressure on the melt in the direction of the surface,
2. maintaining a temperature in the range of about 500°C to about 700°C at the interface until an intermediate layer of an alloy of aluminum and chromium or nickel has been produced at the interface,
3. thermally insulating the surface of the work piece to maintain the temperature,
4. then permitting the melt to solidify as said shaped part under pressure.

2. The process of claim 1, wherein the range of the temperature is about 550°C to about 600°C.

3. The process of claim 1, wherein pressure is exerted on the melt in the direction of the surface after the melt has first been permitted to contact the surface without said pressure while maintaining said temperature and before permitting the melt to solidify.

4. The process of claim 3, wherein the pressure is at least 150 kg/sq.cm. and is exerted until the melt has solidified.

5. The process of claim 4, wherein the pressure is in the range of 170 to 190 kg/sq.cm.

6. The process of claim 4, wherein the pressure is exerted upon the shaped part during solidification of the melt for a period of about 15 to 30 seconds, per 0.2 to 1 kg of melt.

7. The process of claim 6, wherein the period is from 18 to 20 seconds.

8. The process of claim 1, wherein the melt is permitted to contact the surface without exerting pressure thereon for a period of about 2 to 12 seconds.

9. The process of claim 8, wherein the period is from 4 to 6 seconds.

10. The process of claim 1, wherein pressure is exerted on the melt in the direction of the surface after the melt has first been permitted to contact the surface without said pressure while maintaining said temperature and continuing to exert said pressure until the melt has been solidified, the period of pressure at said temperature being at least a quarter of the period of the pressure exerted during solidification.

11. The process of claim 1, wherein the melt is cast at a temperature of about 600°C to 750°C.

12. The process of claim 11, wherein the casting temperature is 640°C to 680°C.

13. The process of claim 1, further comprising the step of regulating the temperature of the work piece.

* * * * *